US009074397B2

(12) United States Patent
Mack

(10) Patent No.: US 9,074,397 B2
(45) **Date of Patent: *Jul. 7, 2015**

(54) ADJUSTABLE DOOR JAMB LOCKS

(71) Applicant: Barry Lee Mack, Paradise, CA (US)

(72) Inventor: Barry Lee Mack, Paradise, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/262,972

(22) Filed: Apr. 28, 2014

(65) Prior Publication Data

US 2014/0230190 A1 Aug. 21, 2014

Related U.S. Application Data

(63) Continuation of application No. 13/624,451, filed on Sep. 21, 2012, now Pat. No. 8,707,521.

(51) Int. Cl.
*E05D 11/10* (2006.01)
*E05D 11/06* (2006.01)

(52) U.S. Cl.
CPC ..... *E05D 11/1007* (2013.01); *Y10T 16/54095* (2015.01); *Y10T 16/540243* (2015.01); *Y10T 16/540253* (2015.01); *Y10T 16/540247* (2015.01); *Y10T 16/5409* (2015.01); *E05D 11/06* (2013.01); *E05D 11/1078* (2013.01); *E05D 2011/1035* (2013.01); *E05D 2011/1092* (2013.01)

(58) Field of Classification Search
CPC ..... E05C 17/54; E05C 17/025; E05D 11/06; E05D 11/10; E05D 11/1007; E05D 11/0018; E05F 2005/00; E05F 2005/02; E05F 5/00; E05F 5/02; E05F 5/06; E05Y 2201/20; E05Y 2201/224
USPC ..... 16/320, 326–328, 351, 352, 353, 380, 16/386, 230–232, 258, 262, 265, 270, 82, 16/86 B, 371, 374, 375, 333, 343; 292/251.5, 253, 254, 106, 137, 341.15, 292/341.17, 359
See application file for complete search history.

(56) References Cited

U.S. PATENT DOCUMENTS

| | | | | | |
|---|---|---|---|---|---|
| 872,650 | A | * | 12/1907 | Gilroy | 16/330 |
| 1,661,113 | A | * | 2/1928 | Deshon | 16/326 |
| 1,758,309 | A | * | 5/1930 | Block | 16/332 |
| 2,240,790 | A | * | 5/1941 | Kuney | 16/334 |
| 2,427,384 | A | | 9/1947 | Bushko | |
| 2,516,183 | A | * | 7/1950 | Carreau | 292/298 |
| 2,550,626 | A | | 4/1951 | Vollmer | |
| 2,670,119 | A | * | 2/1954 | Spluvak | 182/207 |
| 3,325,854 | A | | 6/1967 | Steigerwald | |
| 3,341,240 | A | | 9/1967 | Hazard | |
| 3,608,854 | A | * | 9/1971 | Hamu | 248/316.1 |
| 3,629,900 | A | | 12/1971 | Beeril | |
| 3,744,085 | A | | 7/1973 | Griego | |

(Continued)

*Primary Examiner* — Chuck Mah
(74) *Attorney, Agent, or Firm* — Patent Law Offices of Rick Martin P.C.

(57) ABSTRACT

After traditional door hinges are used to mount a door, a door jamb lock is installed between the door edge and the door jamb. An upper wing is affixed to the door edge. A lower wing is affixed to the door edge. An upper collar holds the upper wing and a central wing pivot pin. This central wing pivot pin can be pushed down to engage a female receiver in the lower collar and lower wing assembly. When this central wing pivot pin engages a key into the female receiver, the door is locked at a desired angle open. Various embodiments include a spring central wing pivot pin, a simple rod type central pivot pin, a three wing version and a fine tuning set screw model for angle adjustment.

3 Claims, 14 Drawing Sheets

(56) References Cited

U.S. PATENT DOCUMENTS

| | | | | | |
|---|---|---|---|---|---|
| 3,874,029 | A | * | 4/1975 | McCullough | 16/329 |
| 3,918,121 | A | * | 11/1975 | Williams | 16/319 |
| 3,969,788 | A | | 7/1976 | McCullough | |
| 4,322,100 | A | * | 3/1982 | McLennan et al. | 292/67 |
| 4,436,331 | A | * | 3/1984 | Glickman et al. | 292/270 |
| 4,501,045 | A | | 2/1985 | Boyer | |
| 4,630,333 | A | | 12/1986 | Vickers | |
| 4,631,776 | A | * | 12/1986 | King | 16/82 |
| 4,648,152 | A | * | 3/1987 | Grewall | 16/82 |
| 4,823,438 | A | * | 4/1989 | Roloff | 16/307 |
| 4,844,519 | A | | 7/1989 | Dagon | |
| 4,918,786 | A | | 4/1990 | Perry | |
| 4,999,937 | A | * | 3/1991 | Bechtold | 40/610 |
| 5,173,993 | A | | 12/1992 | Baker | |
| 5,191,678 | A | * | 3/1993 | Firari | 16/305 |
| 5,408,726 | A | | 4/1995 | Kent | |
| 5,539,954 | A | * | 7/1996 | Ambar | 16/85 |
| 5,588,181 | A | * | 12/1996 | Sutton | 16/252 |
| 5,642,910 | A | * | 7/1997 | Betherum | 292/288 |
| 5,774,938 | A | | 7/1998 | Kent | |
| 6,497,005 | B2 | | 12/2002 | Apostoloff | |
| 6,591,453 | B2 | | 7/2003 | Jenks | |
| 7,000,290 | B1 | * | 2/2006 | Ace | 16/386 |
| 7,096,536 | B2 | | 8/2006 | Johnson | |
| 7,322,629 | B2 | | 1/2008 | McClintock | |
| 7,487,572 | B2 | * | 2/2009 | Nelson | 16/334 |
| 7,891,056 | B2 | | 2/2011 | McAfee | |
| 8,522,400 | B1 | * | 9/2013 | Jablonski | 16/320 |
| 2007/0094844 | A1 | * | 5/2007 | Nelson | 16/337 |
| 2010/0218344 | A1 | | 9/2010 | Van Gennep | |
| 2011/0094058 | A1 | | 4/2011 | Van Gennep | |
| 2013/0212836 | A1 | * | 8/2013 | Jablonski | 16/348 |

* cited by examiner

ADJUSTABLE DOOR JAMB LOCKS

CROSS REFERENCE PATENTS

This is a continuing application claiming priority from U.S. patent application Ser. No. 13/624,451 now U.S. Pat. No. 8,707,521 filed Sep. 21, 2012 claiming priority from provisional application Ser. No. 61/539,799 filed Sep. 27, 2011 and provisional application Ser. No. 61/538,547 filed Sep. 23, 2011.

FIELD OF INVENTION

The present invention relates to providing a pivoting pair of opposing wings with a meshing gear assembly that can lock a door in any desired angle of opened.

BACKGROUND OF THE INVENTION

There are many, many types of apparatus designed to lock a door in position, whether it be closed, partially open, or at any position. Several of the prior art citations listed below incorporate a small locking pin in addition to the main hinge pin (or pintle). These U.S. citations are: U.S. Pat. Nos. 6,591,453; and 7,891,056; 3,969,788. U.S. Pat. No. 4,844,519 uses a pin to lock a hinge-looking apparatus that is installed on the latch side of the door, not the hinge side; furthermore, it only locks a door in the closed position. Certain door locks or stays work in completely different manners than the present invention. U.S. Pat. No. 3,325,854 holds a door open by placing a triangular piece of material in the hinge crack; it is not adjustable. U.S. Pat. No. 2,550,626 operates by means of a piston and cylinder imbedded in the door jamb and wall. U.S. Pat. No. 3,341,240 operates by pivoting a door stop-mounted adjustable rod into the hinge crack to prevent closure—this does not prevent the door from opening further. U.S. Pat. No. 4,630,333 operates by compressing the hinge knuckle around a hinge pin made of thermoplastic. U.S. Pat. No. 773,717 describes a hinge that holds a door open by providing friction between a spring-loaded pin and a disc in the hinge. With the friction system, the door is not "locked" into position, it is merely harder to move and resistant to only light drafts and pushing. Similarly, U.S. Pat. No. 7,096,536 uses friction between two detent discs to provide "dwell points" in the arc of a car door; the car door is never locked at any one position, it simple has preferential resting points. U.S. Pat. No. 6,497,005 discloses a hinge-mounted doorstop that is adjustable, but it only functions to stop a door from opening past a certain point—it does not lock the door into any given position.

Some prior art citations listed below do not address the functionality of the present invention at all, or address different types of "doors." U.S. Pat. No. 820,995 discloses a multiple stay hinge which does not provide any of the door stop/locking/stay functionality of the present invention. U.S. Pat. No. 7,322,629 discloses a way of locking the hinge in a multiple panel apparatus covering a storage cavity in the floor of an automobile. U.S. Pat. Nos. 5,408,726 and 5,774,938 provide a locking ratchet device for a door that holds a door open in the furthest open position reached. The apparatus in these two patents is a safety device for holding open the emergency door of a bus, and does not "lock" a door in position—the door is free to open further at any time, the ratchet simply prevents the door from slamming shut once opened. It is not designed for residential door use.

There are a number of prior art citations that are similar to the present invention in functionality. These citations all modify the central hinge pin to provide the locking functionality. This is accomplished in two ways: compressing "teeth" together, or fitting contoured male and female parts together. Bushko, Beeril, and Baker all use a mechanism to force the end of the hingepin against a toothed surface to provide the locking action. Griego and the two Van Gennep applications use a sliding pin where polygonal or star shaped male plugs slide into female sockets to provide the locking action.

These latter inventions are similar to the present invention in functionality. However, there are key differences that distinguish the present invention from these prior art citations. First, we note that the closest prior art incorporates the locking mechanism into a load bearing hinge. That immediately distinguishes the present invention, since it is not load-bearing. Second, the present invention is not a hinge at all—all of the prior art use the hinge pin in some fashion to effect the locking. The present invention does not have a hinge pin. There is no bearing surface within the present invention that can provide hinge functionality. The present invention works in conjunction with the existing hinges it does not replace them. Third, the present invention is not installed like a hinge it is not mortised into the jamb. The present invention utilizes the space between the door and the jamb by keeping the wings especially thin. The wings are in a different configuration than butt hinges in that they are offset. Fourth, the present invention does not modify the action of any existing hinge or attach to a hinge, it provides the functionality independently of the hinges. Below follows a summary of the known relevant prior art.

U.S. Pat. No. 773,717 (1904) to Craver et al. discloses a door hinge having one leaf formed with a circular plate extending through the knuckles. A spring loaded pin in the enlarged knuckle beneath the plate pressed against the plate, creating enough friction in the hinge such that the door will tend to stick in whatever positions it is placed, even with small drafts.

U.S. Pat. No. 820,995 (1906) to Smith discloses a door hinge with four leaves, all wrapped around a single pintle. The leaves are then attached such that a leaf attaches to both sides of the door, and a leaf attaches to both sides of the door frame.

U.S. Pat. No. 2,427,384 (1947) to Bushko discloses a door hinge containing two pin members in the knuckles. The lower pin is fixed, and has teeth on its top surface, the upper pin can slide in the knuckles, and its lower surface also has teeth. There is a spring pushing the top pin downward such that the teeth engage and lock the two pin members together, thus prevention the door from opening or closing. The spring can be held back with a cam arrangement so that the door may be position. Thus, a door can be locked in place in a variety of position, including fully closed.

U.S. Pat. No. 2,550,626 (1951) to Vollmer discloses a door stop that slows a door closing or locks it in an open position—it comprises a sleeve and sliding piston embedded in the door casing. This piston is connected to the door by an arcuate head portion screwed into the edge of the door. Friction between the piston and the sleeve slows the closing of the door. The piston is such that rotating the piston rod expands or constricts the friction surface of the piston, increasing/decreasing/stopping the closing speed of the door.

U.S. Pat. No. 3,325,854 (1967) to Steigerwald discloses a door stop consisting of an angled piece of resilient material attached to the top of the pintle by a swiveling link. Thus, the material can be positioned such that it forms wedge between the door and the door jamb, holding it open. It also can be flipped through the door crack and used on the outside, preventing the door from opening beyond a certain point. There is no adjustability as to the angle the door is held open.

U.S. Pat. No. 3,341,240 (1967) to Hazard discloses a 21 door stop consisting of a pivoting blocker attached to the 22 door stop on the door jamb. When pivoted out of the way, the 23 door closes normally. When the door opens, the door stop 24 can be pivoted into the space between the door and the jamb. A longitudinally adjustable member adjusts how far open the door is held.

U.S. Pat. No. 3,629,900 (1971) to Beeril discloses locking door hinges as regular butt hinges where the pintle has toothed caps on each end. The teeth from these caps mesh with teeth on the top and bottom knuckle. The pintle extends beyond the top knuckle, where a cam lever makes it possible to tighten the pintle such that the teeth are tightly engaged against the knuckles, thereby locking the door in any position open or closed.

U.S. Pat. No. 3,744,085 (1973) to Griego discloses a door hinge where the pintle has polygonal plugs spaced along its length. The leafs of the hinges have matching polygonal sockets where the knuckles are. The pintle is held by a spring on the end such that the polygonal plugs engage the sockets and hold the door in a set position. To operate the door, the user presses down on the pintle, which slides such that the polygonal plugs are no longer in the sockets, and the hinge leafs are free to rotate about the pintle in normal fashion. When the desired door position is reached, releasing the spring raises the pintle so that the polygonal plugs again engage the sockets and the door will not move. U.S. Pat. No. 3,969,788 (1976) to McCullough discloses a hinged door lock that can be used in place of the strike plate or as hinge itself for cabinet doors. If one leaf replaces the strike plate, the other leaf extends out and folds over the closed door. A locking pin then holds the lock hinge in a 90-degree angle, locking the door itself. If used as a hinge, the door is attached to the second leaf, and when closed the locking pin inserts into the pintle, locking the door in place (hinge leaves in a 90 degree angle).

U.S. Pat. No. 4,630,333 (1986) to Vickers discloses an adjustable friction hinge made of thermoplastic material. One leaf has two knuckles, and holds the hinge pin. The other leaf has a single knuckle with an adjusting screw, such that the adjusting screw tightens the knuckle, clamping the hinge pin. By adjusting the tightness of the adjusting screw, friction around the hinge pin is set such that the hinge still rotates under force, but remains in position when no active force is applied.

U.S. Pat. No. 4,844,519 (1989) to Dagon discloses a door lock with locking pin. This lock has one plate attached to the door jamb and the other plate attached to the door itself, such that when the door is closed, knuckles extending from the plates mesh together and form a channel through which a pin is placed. This device only locks a door in closed position, not in any position determined by the user.

U.S. Pat. No. 5,173,993 (1992) to Baker discloses a locking door hinge where the pintle is keyed to remain fixed with respect to one hinge plate. On top of the pintle is a locking clutch mechanism consisting of pressure and socket plates which are adjustable to allow retention of the door in any pivotal position.

U.S. Pat. No. 5,408,726 (1995) to Kent discloses a ratchet locking device that when retrofitted to an existing door hinge, automatically locks the door in an open position. This is envisioned for a school bus emergency exit door, such that, no matter the position of the door, as it is opened, the ratchet locks it open at the farthest point of travel, thus allowing escape without the door swinging shut. There is a release mechanism to allow the door to shut when necessary.

U.S. Pat. No. 5,774,938 (1998) to Kent discloses the same idea as U.S. Pat. No. 5,408,726, with improvements to the apparatus disclosed there.

U.S. Pat. No. 6,497,005 (2002) to Apostoloff discloses a door stop that only prevents a door from opening beyond a predetermined setpoint. This is a metal door stop that attaches to the existing hingepin and is adjustable to limit the opening of the door.

U.S. Pat. No. 6,591,453 (2003) to Jenks discloses a locking hinge system where the knuckles extend out beyond the hinge pin aperture and have a second aperture that receives a locking pin. The knuckle extensions align together when the door is closed, allowing the pin to be inserted into the second aperture, preventing the door from being opened. When the door swings open past 90 degrees, the extensions pass by each other, such that if the pin is now inserted into the second aperture, it prevents the door from swinging shut. The two locked positions are either fully closed or greater than 90 degrees open, there is no adjustment.

U.S. Pat. No. 7,096,536 (2006) to Johnson discloses a hinge apparatus with cam plates attached to each hinge part. The hinge pin connects the parts centrally though the cam 1 plates. The cam plates have detents in them, and ride on each other. As the door opens, the cam plates rotate and tend to resist rotation when the detents match up. Envisioned for a car door, the hinges tend to hold the car door open at certain points.

U.S. Pat. No. 7,891,056 (2011) to McAfee discloses a locking door hinge that holds a door in predefined positions by means of a pin in the barrels of the hinge connecting them together. The hinge barrels will have small holes down through them at different positions corresponding to different angles of openness. At each available locking position, certain holes will line up, allowing the locking pin to connect the barrels of the hinge and hold the door in position.

U.S. Pat. Application Publication No. 2010/0218344 to Van Gennep discloses a door hinge assembly consisting of a hinge pin and a cylindrical channel having surfaces at one end of the pin and channel designed to mesh together in a locked fashion (star, polygonal, etc). The hinge pin is able to slide up and down through the cylindrical passage through the hinge knuckles such that when the hinge pin is elevated, the meshing surfaces do not meet, and the hinge is free to pivot as any normal hinge would. When the hinge pin is pressed down, the contoured surface on the end of the pin 20 slides down into the meshing surface of the lower knuckle. The hinge pin is held fast to the other hinge leaf by the means of detents. Thus, when the pin is down, the hinge is locked in position. A helical spring is optionally specified to hold the hinge pin up (the unlocked position).

U.S. Pat. Application Publication No. 2011/0094058 to Van Gennep consists of a continuation-in-part of U.S. Pat. App. Pub. No. 2010/0218344.

In summary the present invention provides a non-obvious improvement over the prior art door jamb locks. The present invention is installed to an existing hinge mounted door between the door and the jamb itself. Opposing wings can be locked by engaging a gear assembly merely by pushing down on the wing pivot pin that connects the opposing wings.

SUMMARY OF THE INVENTION

The main aspect of the present invention is to provide a pivoting pair of wings that can be mounted to a door and its door jamb, wherein locking gears in the wing collar can lock the door open at any angle.

Another aspect of the present invention is to provide a vertical wing pivot pin with a locking gear that engages by pressing down on top of the wing pivot pin.

Other aspects of this invention will appear from the following description and appended claims, reference being made to the accompanying drawings forming a part of this specification wherein like reference characters designate corresponding parts in the several views.

The present invention consists of a pair of wings mounted to a door edge and an opposing pair of wings mounted to the door jamb. A wing pivot pin pivotally engages the collars of the respective wings much like a traditional hinge. Inside the collar is a female gear with vertical grooves. The wing pivot pin has a movable male gear that can move down to engage the female gear at a desired angle to lock the door open. Unlocking the door is done by pushing up on the wing pivot pin.

The present invention is novel in that it can instantly be installed to a door installation that is mounted by typical standard mortised butt hinges without mortising. There are many and various brands and designs of butt hinges that are used worldwide and used in residential homes and apartments, high rise commercial office buildings and hotels, medical centers, hospitals and etc. that are slightly different in thickness, depth, height, size of hinge pin, distance of hinge pin center from plane of door and jamb, required mortise depth, width and length. Perhaps the most novel aspect of the present invention is the use of the gap that exists between the door edge and the jamb. One model can be used and installed in nearly any mortise butt hinge hung door installation conceivable. Nearly every mortised butt hinge hung door installation has one thing in common; a gap of approximately 0.0800" to 0.0930" between the door and jamb when properly installed. Most every mortise butt hinge for different door thicknesses and widths is designed to furnish a gap within this tolerance when properly installed in the appropriate mortise. This gap and its typical size is for many various reasons to include but not limited to clearance for slight changes in size due to seasonal influences, clearance on the opening edge of the door to clear the jamb as it is pulled open, as well as maintaining a visually appealing reveal around the door edge. Because of this stereotypical gap the present inventions use of this gap allows instant installation of the present invention. It is a matter of placing it in the gap and moving the centerline of the present invention locking pin in line with the hinge centers of the door installation and fastening it into position. The present inventions typical wing thickness is approximately 0.0800" which is designed to facilitate the majority of installation situations. It is conceivable that some models of the present invention will have slightly thicker wings so as to accommodate heavy duty industrial applications whereas the gap is larger.

The individual wings of the present invention are located in the same vertical plane when the door is closed. When in the closed position each wing respectively is either above or below the other. Each wing is 0.0800" in thickness, and because of this feature the present invention only requires 0.0800" for installation and function.

The present invention solves a very old but universal problem; namely how to hold a typical entry or interior butt hung hinge door open, easily, safely, effectively, attractively and affordably. Even in this age often times one will see a brick or a stack of books or a chair holding a door open because there has not been until this present invention an instant, simple, dependable and easy to use, easy to install device to address this problem. Fire code has made the use of wedges, bricks, or chairs or the like illegal to use in public buildings in many states in the United States. In case of fire emergency a door in a public building must be able to be closed instantly with "one motion to close". The present invention provides this function. The present invention installs instantly on any typical butt hinge hung door, wood or steel, residential or commercial as it installs in the stereotypical gap that exists between the door and the door jamb on the mortised hinge side. There is absolutely no mortising or machining of the door or the jamb for the present invention to be installed. A simple drill and screwdriver is all that is needed for quick installation. The present invention will function equally well on door installations that open 90 or 180 degrees more or less. The same model can be mounted on right and left hand swing installations. It can be installed high or low depending on individual preference so that it is operated without stooping or bending or reaching high above their head. With the present invention installed on these typical door installations, our wheel chair bound population and people that have disabilities affecting their mobility can instantly push a button to cause a door to stay open so they can independently ingress or egress one time or many without struggling with the door repeatedly. The present invention can function equally well on doors that have self-closers on them and still meet the "one motion to close" fire code requirements. The force required to pull the door closed in a commercial duty model is adjustable using internal spring resistance to set the release pressure. There is no other door stay or door hold open device that accomplishes all that this present invention accomplishes.

BRIEF DESCRIPTION OF THE DRAWINGS

FIG. 3AA is an exploded view of the spring retraction mechanism 80 of FIG. 3A.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
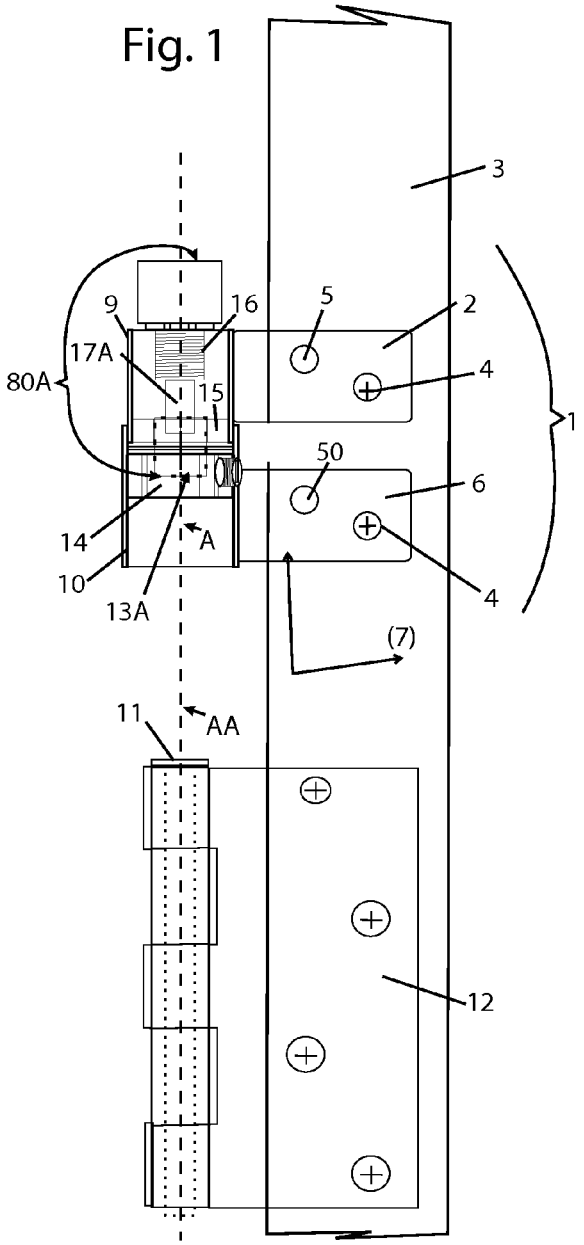
FIG. 1 is a front elevation view of a spring return embodiment installed in a locked position.
Figure 2:
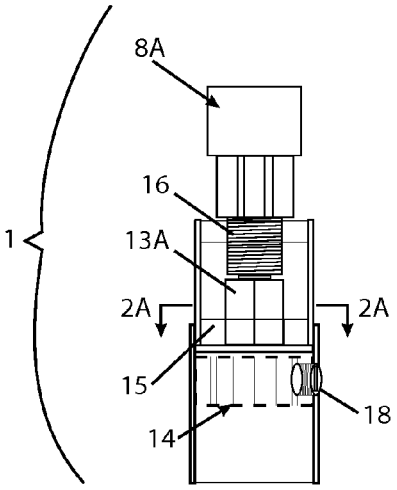
FIG. 2 is a front elevation view of the spring return lock alone shown in the unlock position.

Referring first to FIGS. 1 and 2 the door jamb lock 1 has an upper wing 2 affixed to the door jamb 3 via screws 4 through holes 5 in the upper wing 2. A lower wing 6 is affixed to the door edge 7 via screws 4 through holes 50 in lower wing 6. A movable wing pivot pin 8A is secured inside upper collar 9 and lower collar 10. This moveable assembly can be achieved by numerous methods, in this case an indexing plunger application Ser. No. 10/077,021 US 2003/0156923 A1, incorporated herein by reference, was modified to provide 17A and BS to function. Threads 16 affix it to collar 9. The vertical axis A of the movable wing pivot pin 8A is aligned with the vertical axis AA and centerline of the door hinge pin 11 of door hinge 12. FIG. 1 shows the wing pivot pin pushed down, thereby engaging key 13A into the female receiver 14 which is rigidly mounted inside lower collar 10. The upper washer 15 is rigidly mounted inside upper collar 9. Upper washer 15 with a hex nominally a 12 point socket shaped center hole locks the hex key 13A from any rotational movement. Thus, as shown in FIG. 1, the key 13A locks the female receiver 14 and the lower collar 10 and the lower wing 6 and the door edge 7 in a fixed and locked rotational orientation in relation to the stationary door jamb 3.

Figure 2A:
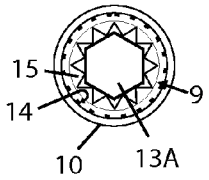
FIG. 2A is a sectional view taken along line 2A-2A of FIG. 2.
Figure 2B:
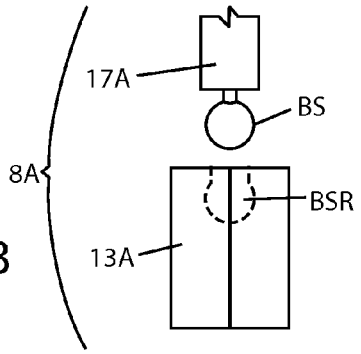
FIG. 2B is an exploded view of the ball stud and socket of FIG. 2.

Referring next to FIGS. 2, 2A, 2B the wing pivot pin 8A is shown in the up and unlocked position which has raised the key 13A out of the female receiver 14. Piston 17A is connected to key 13A by means of a ball stud BS on the end of 17A and a receiving ball socket BSR in the end of 13A. This spring loaded assembly can be made in numerous ways such as described in U.S. Pat. No. 3,819,282 incorporated herein by reference in its entirety. This spring loaded embodiment uses a spring loaded piston 17A to retract the key 13A upward out of the female receiver 14 as seen in FIG. 2. The wing pivot pin 8A was pushed partially down from the locked position shown in FIG. 1. When released the spring retraction mechanism 80A pulled the piston 17A and key 13A upward. An optional set screw 18 allows adjustment of the female receiver 14 in the lower collar 10 at installation time to accommodate minor angle variances between the door jamb 3 and the door edge 7.

Figure 3:
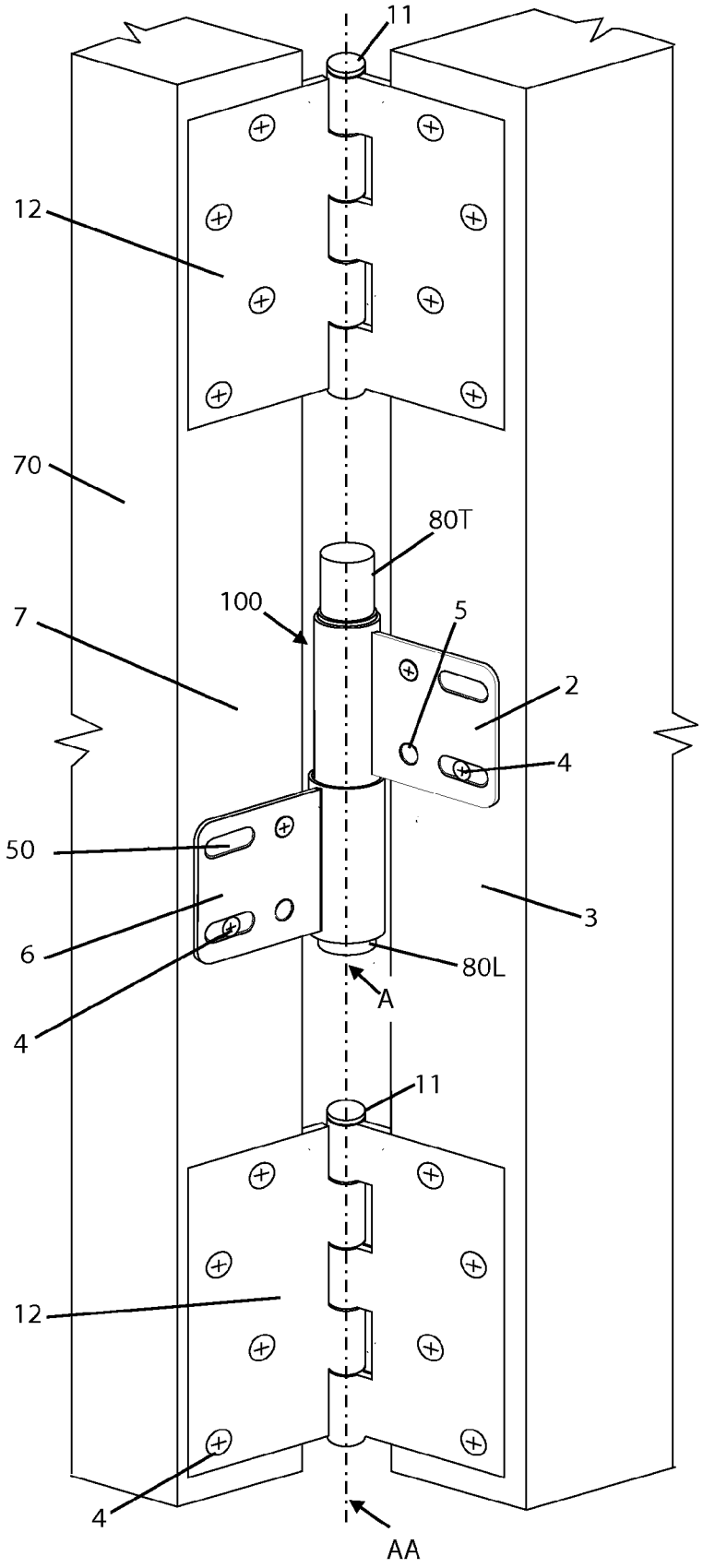
FIG. 3 is a front perspective view of a mechanical lock (a second embodiment) installed and in the unlocked position.
Figure 3A:
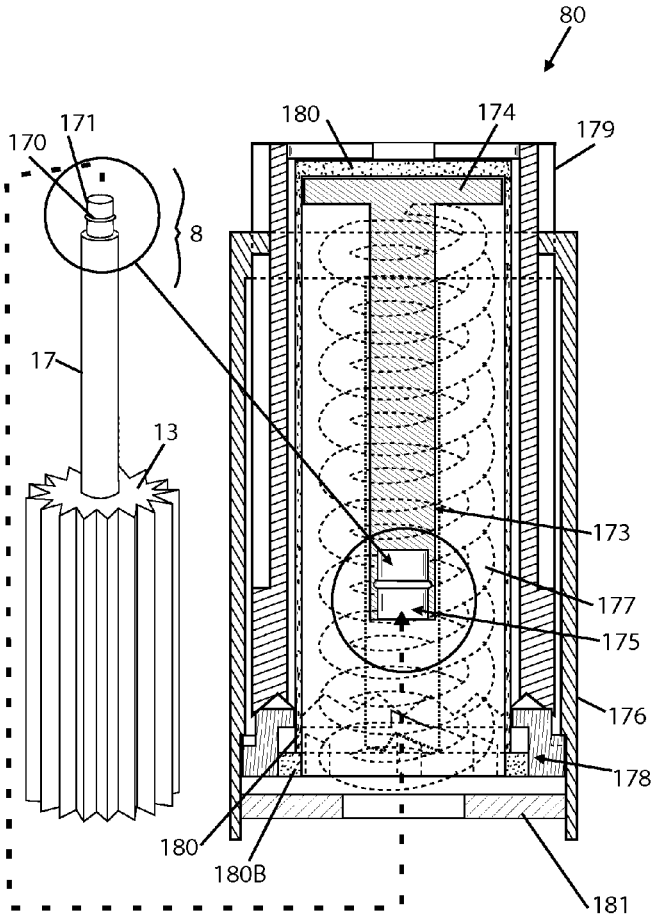
FIG. 3A is a cross sectional view of a spring return lock 80.
Figure 3A:
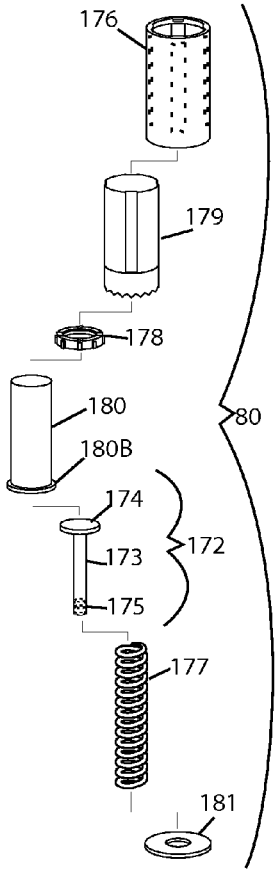

Referring next to FIGS. 3A, 3AA, 3B, 3C the spring retraction mechanism 80 consists of the movable wing pivot pin 8. Many pop up mechanisms like this are known in the art, and U.S. Pat. No. 3,376,088 is incorporated herein by reference. The wing pivot pin 8 has a top spline 171, which in turn has a male ridge 170 and connected to pivot pin 8 is the locking key 13 connected to the piston 17. The button plunger 172 has a lower inside female receiving cavity 175 in its shaft 173 that receives pivot pin 8. The top 174 of assembly 172 fits into spring housing 180. The locking washer 178 slides on 180 to rest on the ridge 180B. The washer 181 is affixed solidly to the bottom of button housing 176 enclosing all components inside of button housing 176. The button housing 176 is affixed to upper collar 9.

Figure 3B:
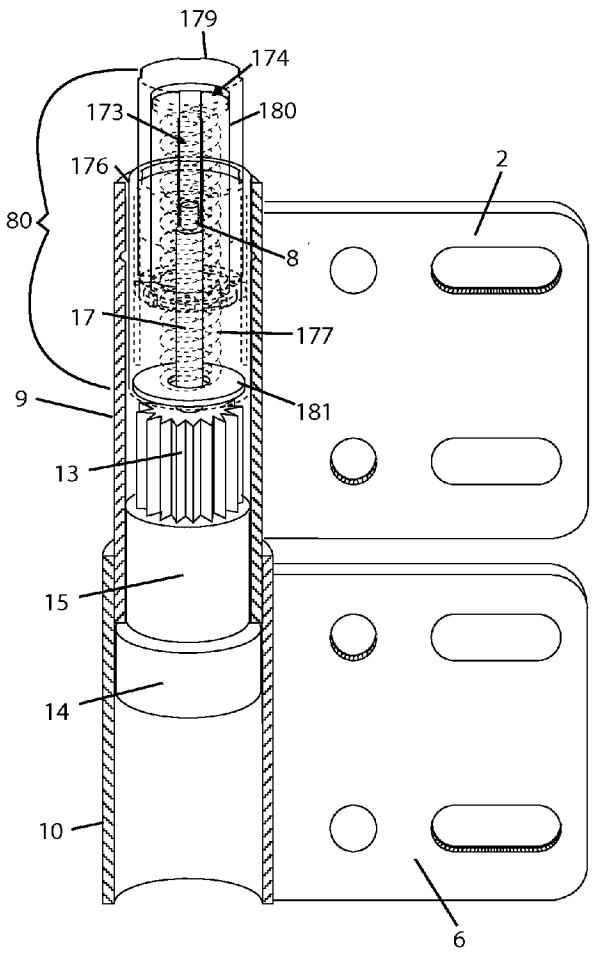
FIG. 3B is a sectional view of the spring return lock in the free position.
Figure 3C:
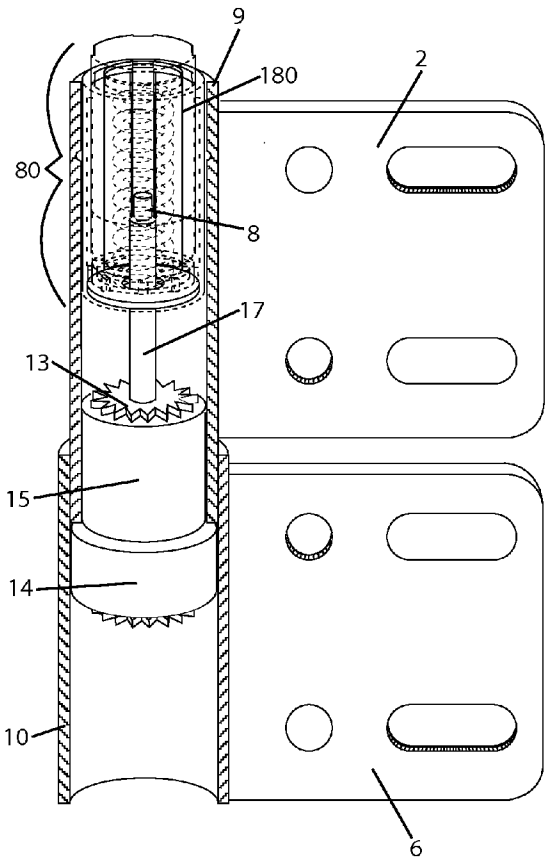
FIG. 3C is a sectional view of the spring return lock in the locked position.
Figure 4:
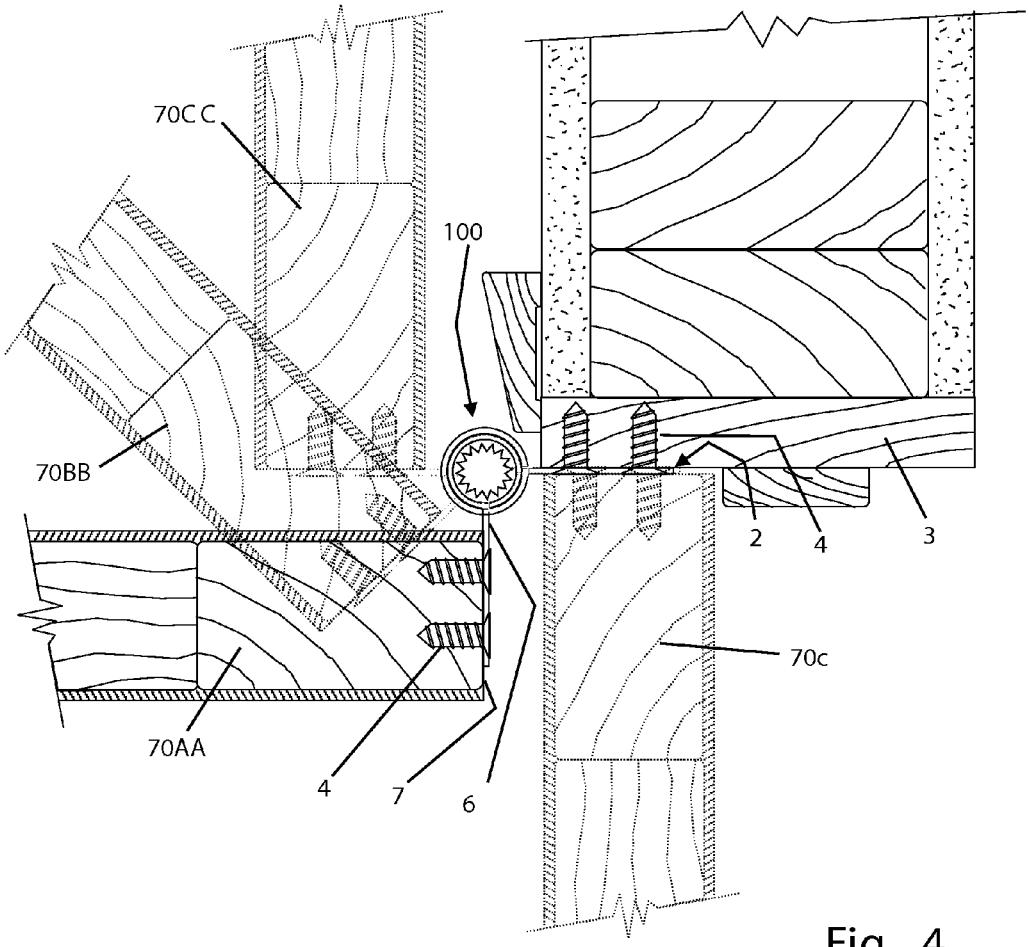
FIG. 4 is a horizontal sectional view of FIG. 3.
Figure 9:
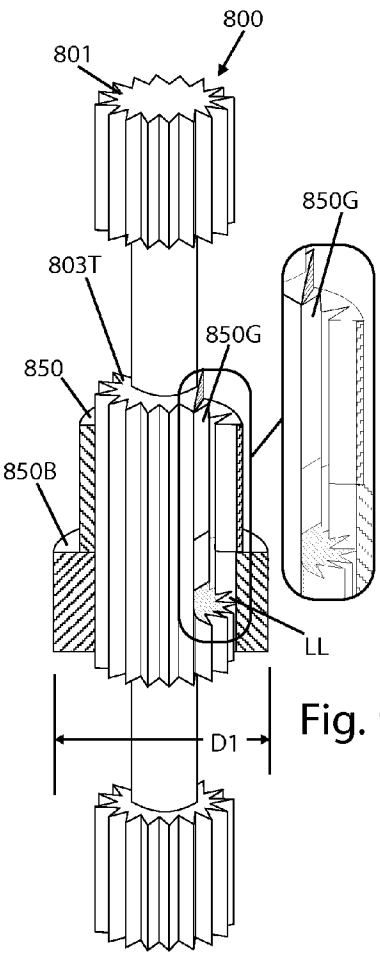
FIG. 9 is the same view as FIG. 8 showing a close-up view of the meshing gears.
Figure 8:
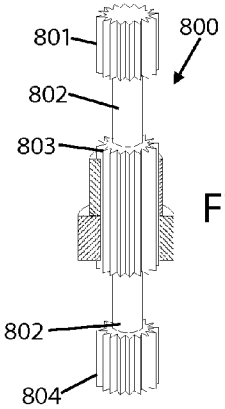
FIG. 8 is the same view as FIG. 6 in the locked position.
Figure 7:
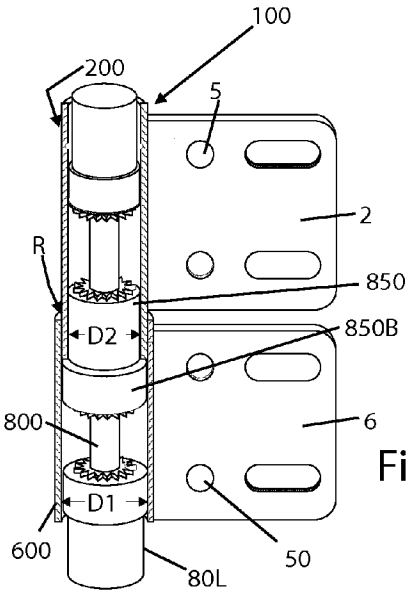
FIG. 7 is the same view as FIG. 5 in the locked position.
Figure 5:
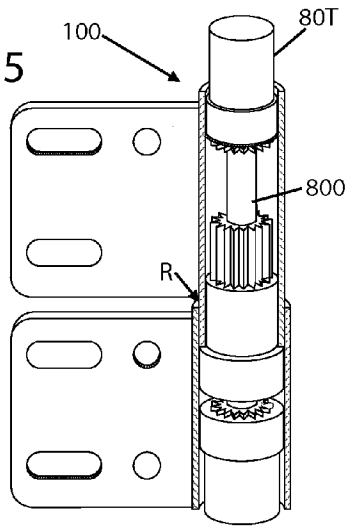
FIG. 5 is a vertical sectional view of the second embodiment lock in the unlocked position.
Figure 6:
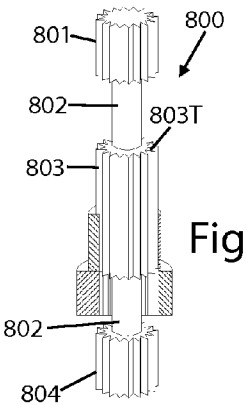
FIG. 6 is the same view as FIG. 5 in a cutaway mode.
Figure 10:
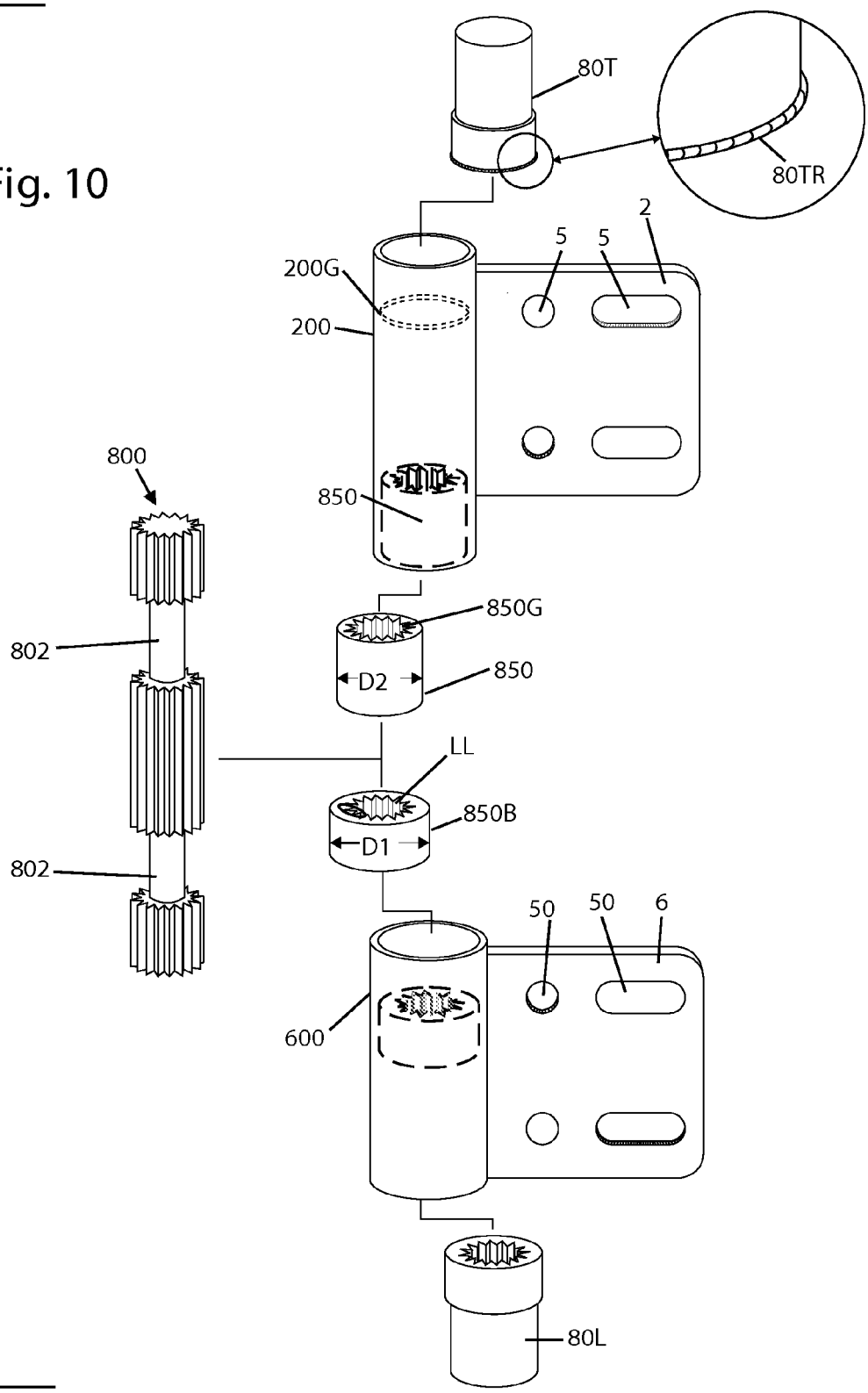
FIG. 10 is an exploded view of the preferred second embodiment.

The spring 177 as shown in FIG. 3B is in the passive mode so that the spring presses in concert against the bottom of 174 which pushes against the (inner) top of 180 which pushes against the (inner) top of button 179 (thereby pushing against affixed washer 181 locating it in disengaged position.) FIG. 3C illustrates button assembly 80 in locked mode holding locking key 13 down through and engaged in female receiver 14 holding wing 6 rotationally locked. Referring next to FIGS. 3, 4 a simple central pivot pin lock 100 is shown mounted in the same way as lock 1 shown in FIG. 1. Door 70 has edge 7 which receives wing 6. The top of the central pivot pin and button assembly is labeled 80T. Top 80T is shown in the up position, which is the unlocked position. FIG. 4 shows door 70 in the closed position C and various open positions AA, BB, CC.

Figure 11:
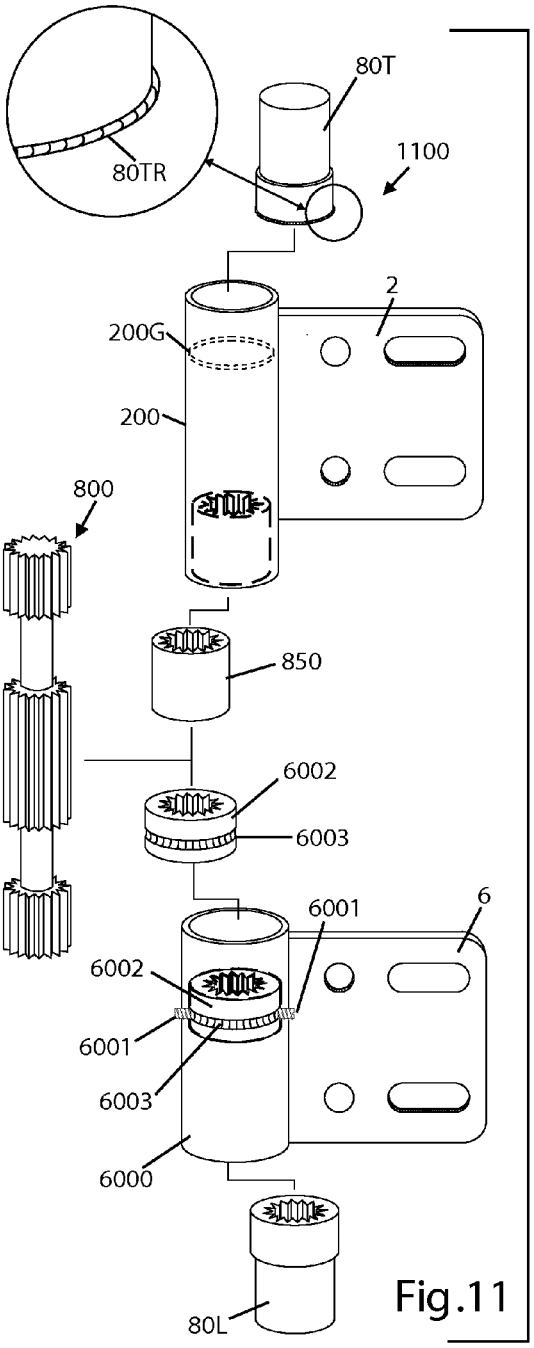
FIG. 11 is an exploded view of a third embodiment lock.
Figure 12:
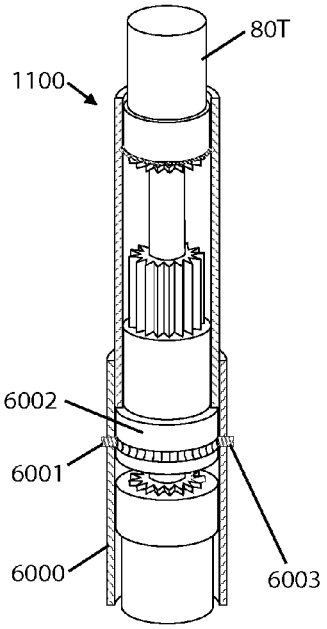
FIG. 12 is a vertical sectional view of the third embodiment lock shown in FIG. 11.

Referring next to FIGS. 5-10 the lock 100 has a simple and elegant design. The upper wing 2 is attached to its upper collar 200. The lower wing 6 is attached to its lower 19 collar 600. Upper collar 200 rotates inside the upper portion of lower collar 600 as shown by arrow R. A central pivot pin 800 has an upper segment 801 to hold button 80T. A central rod 802 supports gears 801, 803 and 804. Gear 804 supports a lower button 80L. Gear 803 has vertical teeth 803T which are received by the female receiver 850 in grooves 850G. A locking bushing 850B has a diameter D1 to fit securely inside the lower collar 600. The diameter D2 of the female receiver 850 (which is a guide bushing for the gear teeth 803T) is sized to fit securely in the upper collar 200. Thus, when button 80T is pushed down a compressible protruding radius retaining ridge 80TR is compressed and forced out of receiving groove 200G. The gear teeth 803T slide into locking grooves LL of the locking bushing 850B. Pushing up on button 80L causes gear teeth 803T slide out of the locking grooves LL unlocking bushing 850B. As button 80T returns to the disengaged position the ridge 80TR expands into groove 200G thereby holding the pin 800 up in the unlocked position. The embodiment shown uses a 16 star point gear 803 which limits each door opening angle to 22.5 degree increments. This is merely a design choice. Referring next to FIGS. 11, 12 the lock 1100 is the same as lock 100 but for an angle adjust feature which replaces the locking bushing 850B with movable bushing 6002. Movable bushing 6002 has a toothed groove 6003 to enable the set screws 6001 to lock it inside lower collar 6000. Lower collar 6000 has threaded holes which secure the set screws 6001.

Figure 13:
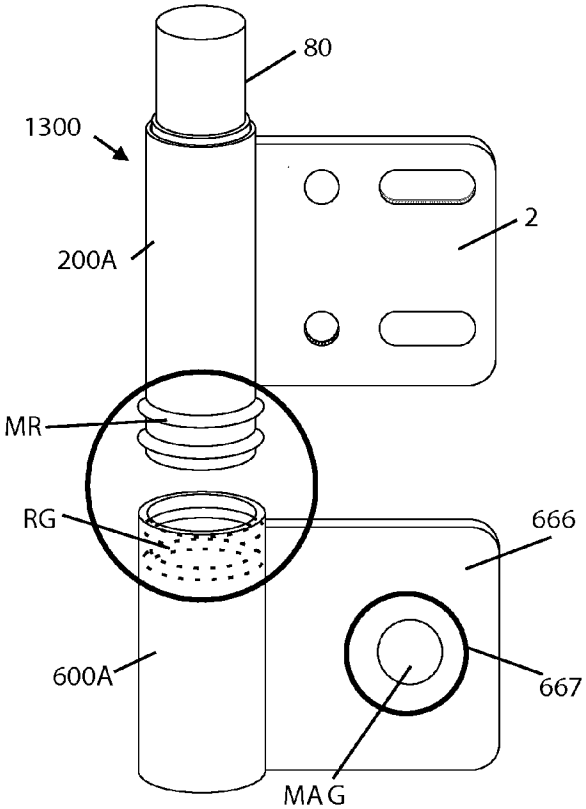
FIG. 13 is a front elevation view of non-screw to door edge 7 using magnetic attraction embodiment.

Referring next to FIG. 13 a door jamb lock 1300 has a lower wing 666 that doesn't require screwing into the door edge. Instead a double sided sticky tape 667 could hold the wing 666 against the door edge. Another embodiment could have a metal washer as part 667, wherein a magnet MAG is screwed into the door edge. These embodiments are easier to install without the door edge screws. Collar 600A has receiving grooves RG for male ridges MR on collar 200A. This feature attaches collar 600A to upper collar 200A so the collars rotate freely while maintaining adjacent connection to each other.

Figure 14:
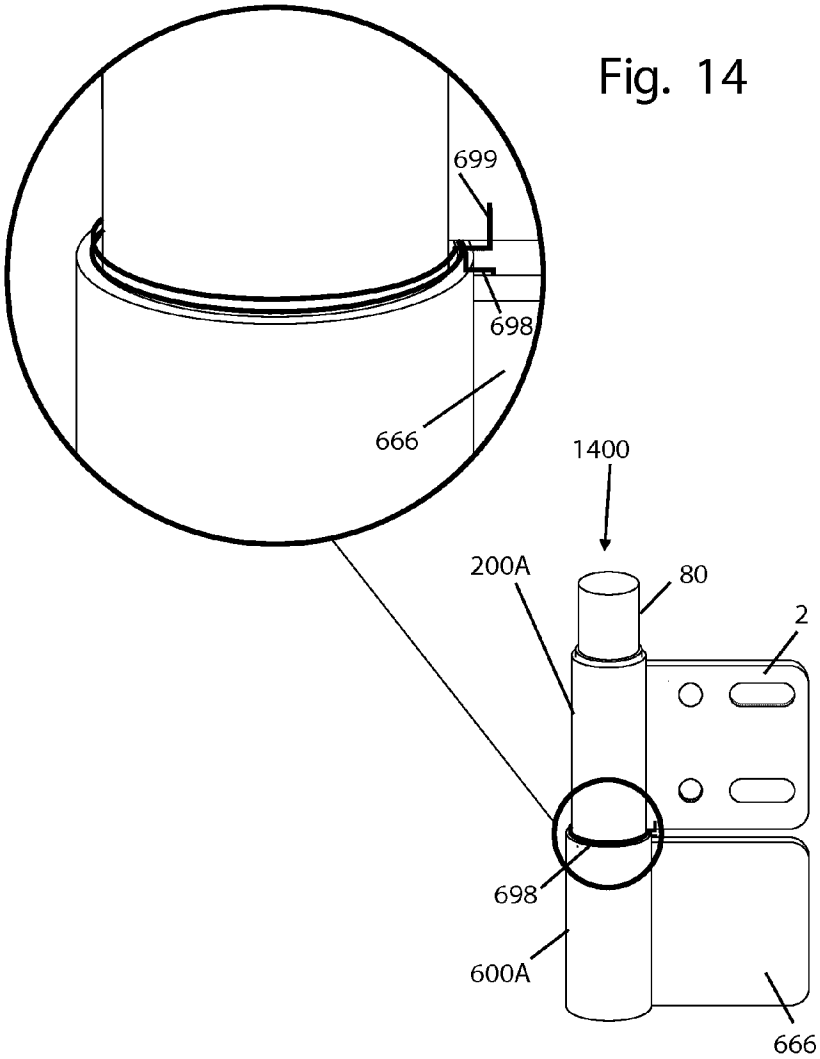
FIG. 14 is a front elevation view of non-screw to door edge 7 using spring force embodiment.

Referring next to FIG. 14 a door jamb lock 1400 again has a non-screw lower wing 666. A circular spring 698 secured around collar 200A has an end leg 699 that urges the wing 666 to stay against the door edge.

Figure 15:
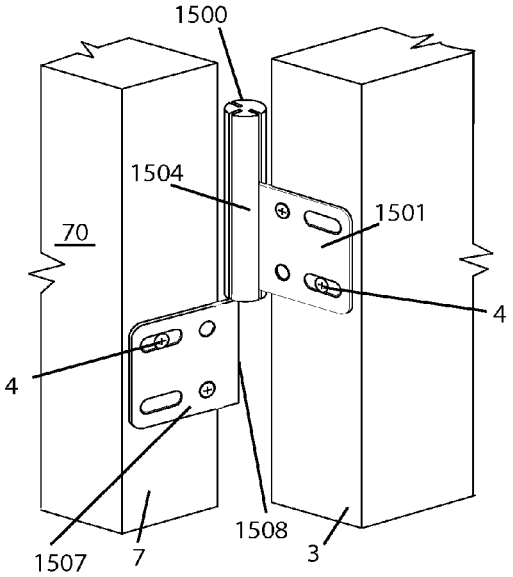
FIG. 15 is a front perspective view of embodiment 1500 in the unlocked mode.
Figure 16:
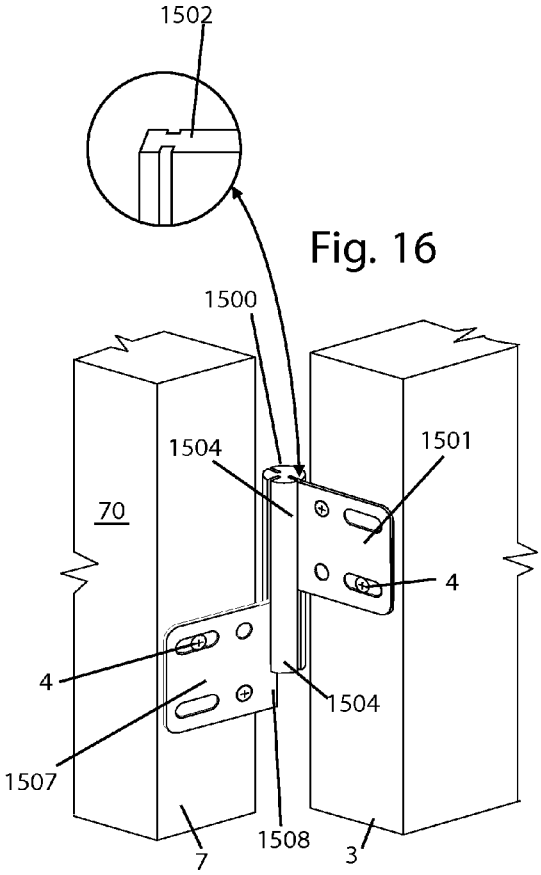
FIG. 16 is the same view as FIG. 15 in the locked mode.
Figure 17:
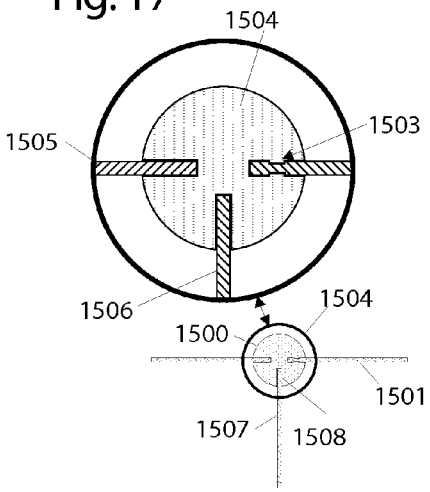
FIG. 17 is a top plan view of the plunger of embodiment 1500.
Figure 18:
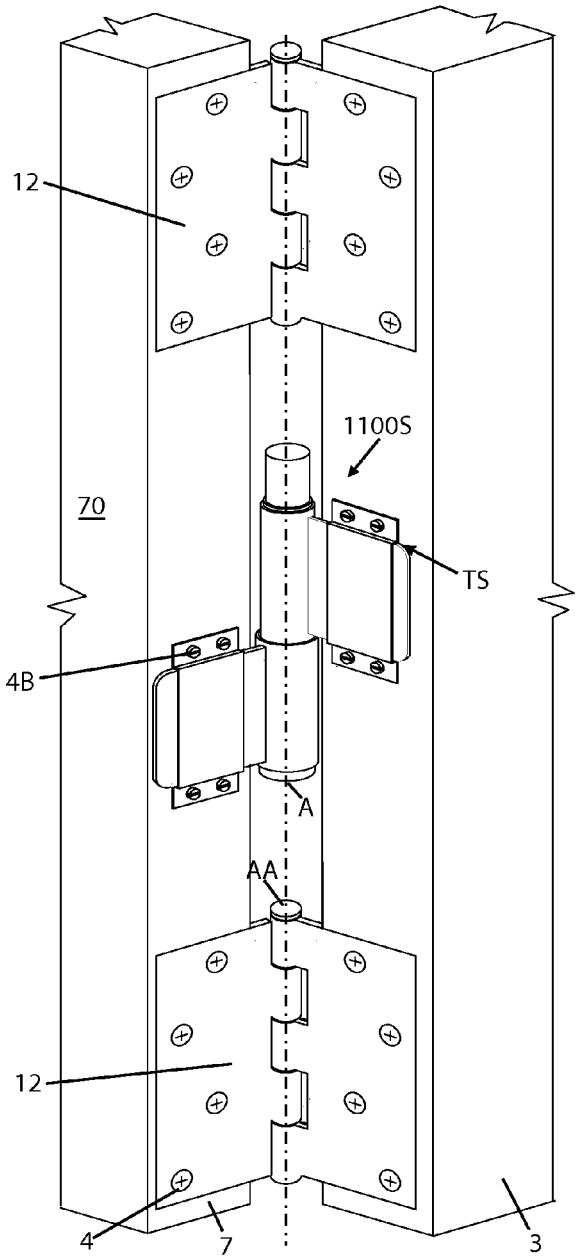
FIG. 18 is a front perspective view of the clamp fastener 1100S.
Figure 19:
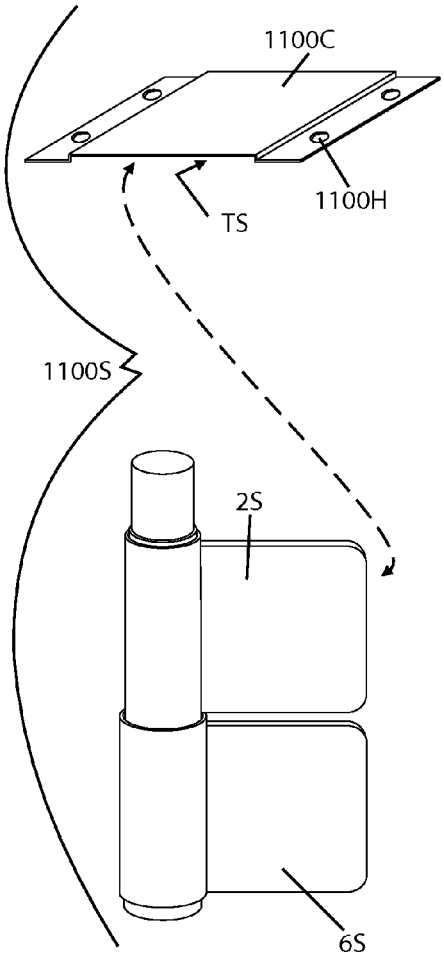
FIG. 19 is an exploded view of the clamp fastener 1100S.

Referring next to FIGS. 15, 16, 17 a door jamb lock 1500 consists of three pieces. A door jamb wing 1501 is screwed into the door jamb 3. It has a grooved edge 1502 that mates with groove 1503 of the plunger 1504. The plunger 1504 has one or more jamb grooves 1505, 1506. In FIG. 15 the plunger 1504 is raised so as to not engage the door wing 1507. FIG. 16 shows the plunger 1504 pushed down to engage the inner edge 1508 of the door wing 1507. FIGS. 18, 19 show a door jamb lock 1100S that works like door jamb lock 1100, however, the wings 2S, 6S do not have screw mounting holes. Instead a clamp 1100C with holes 1100H is screwed into the respective door and jamb. A thin slot TS receives the respective wings 2S, 6S. Installation is easier because the relative position of the wings 2S, 6S in the slots TS adjust themselves in line with hinge axis line AA to door jamb lock axis line A in one cycle of opening door.

Figure 20:
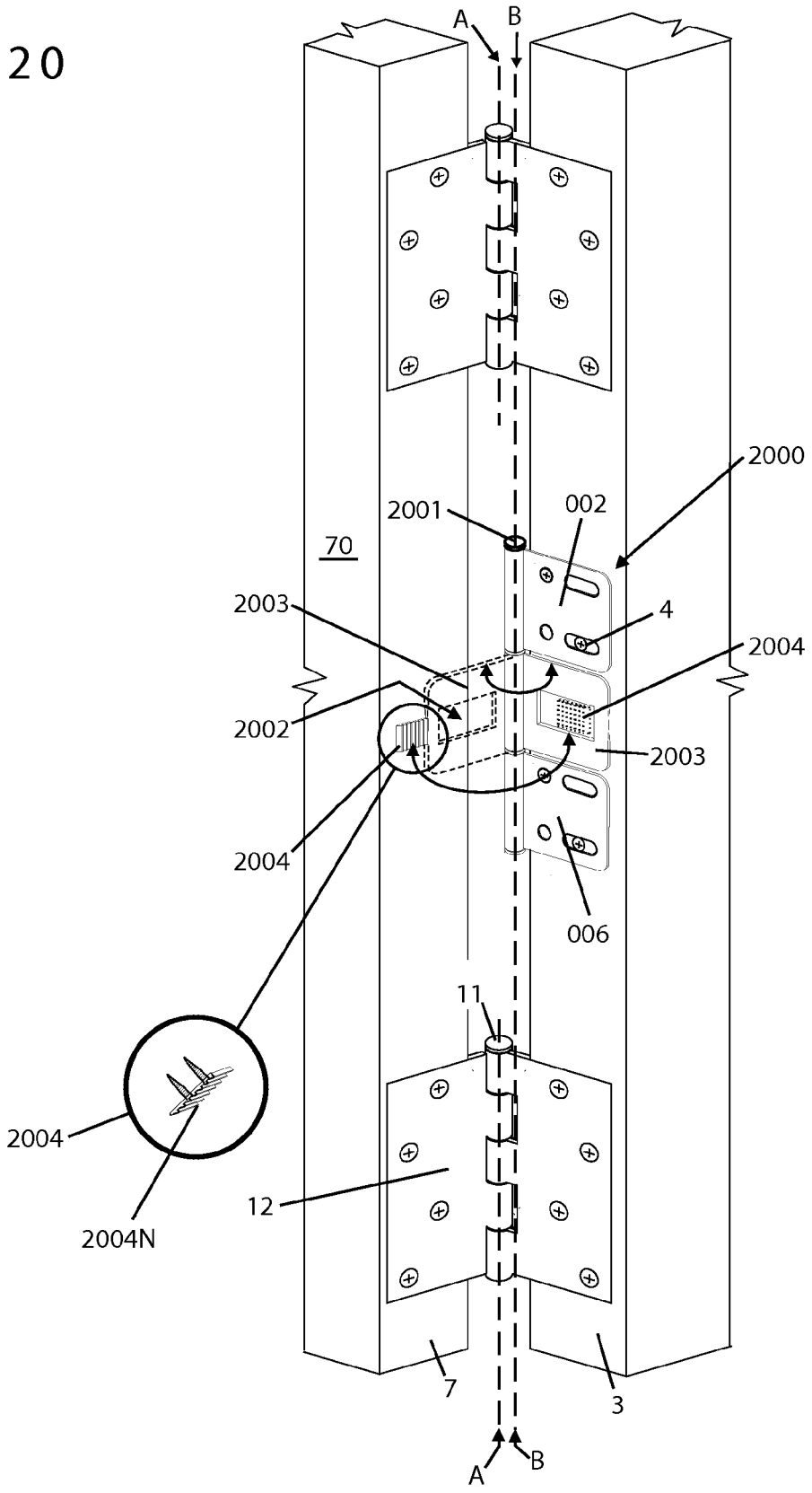
FIG. 20 is a front perspective view of embodiment 2000.
Figure 21:
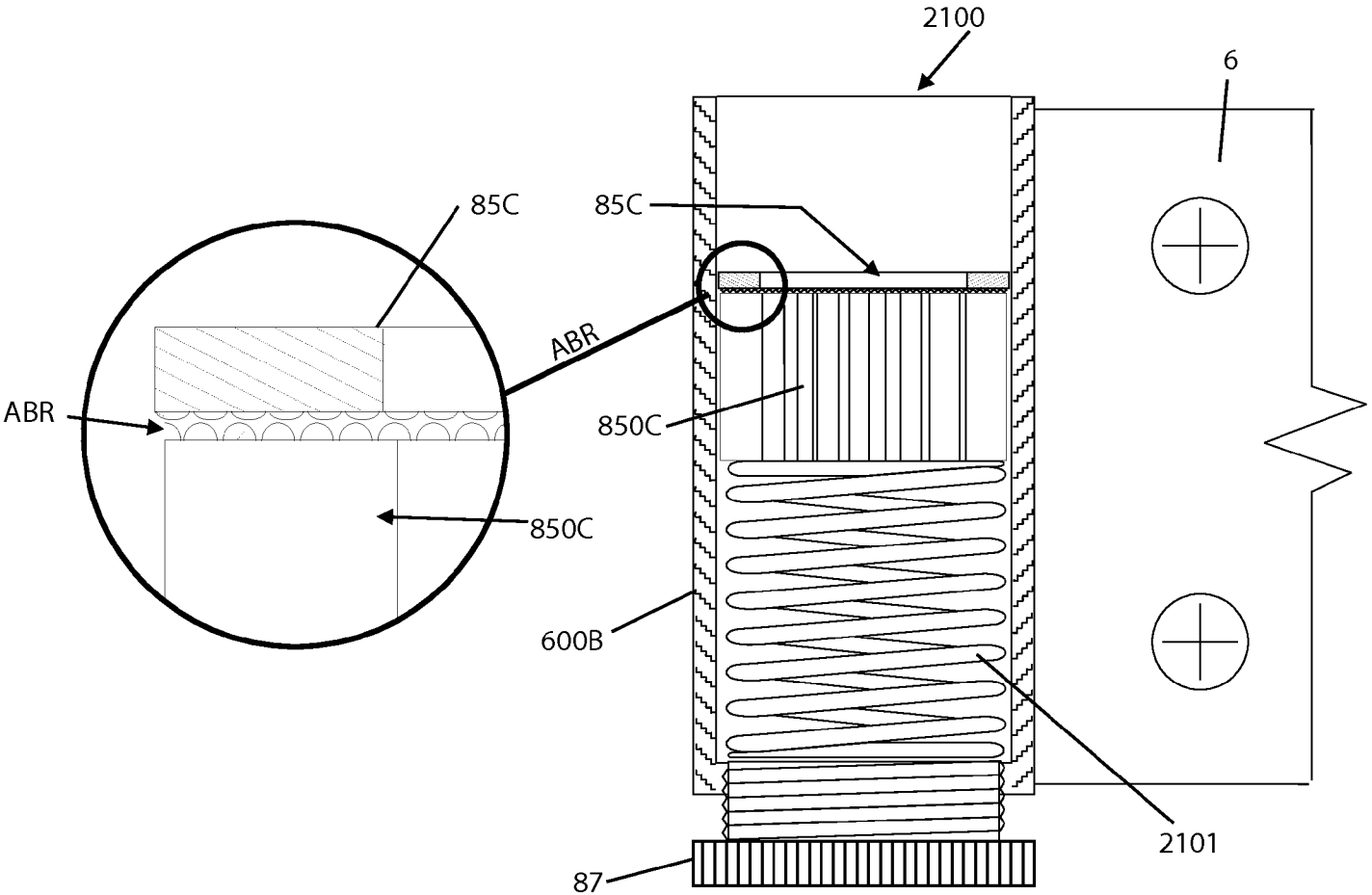
FIG. 21 is a cross sectional view of adjustment embodiment 2100.

In FIG. 20 a door jamb lock 2000 has a pin 2001 aligned in axis B which is off center from axis A of the hinges 12 hinge pin 11. Wing 002 and wing 006 are affixed to door jamb 3 by way of screws 4. Wing 2003 is allowed to swing freely on common pin 2001. When door 70 is opened and wing 2003 is lifted open its edge will be placed in any one of the notches 2004N in stop 2004 which is installed on door edge 3 holding door in chosen position. By lifting the locking wing 2003, the door is released. Hole 2002 in wing 2003 allows stop 2004 to reset in 2002 when door 70 is closed. In FIG. 21 a jamb 2100 has an infinite angle adjustment for the lower sleeve 600B, for various embodiments. Thumbwheel 87 can be tightened to force spring 2101 into movable lock bushing 850C. Sleeve 600B houses the thumbwheel 87. The stop washer 85C is fixed. The abrasive meshing ABR between the bushing 850C and stop washer 85C is locked by tightening the thumbwheel 87. The jamb 2100 functions the same as lock 100 shown in FIG. 7. The upper wing 2 and pivot pin 800 are not shown in FIG. 21.

Figure 22:
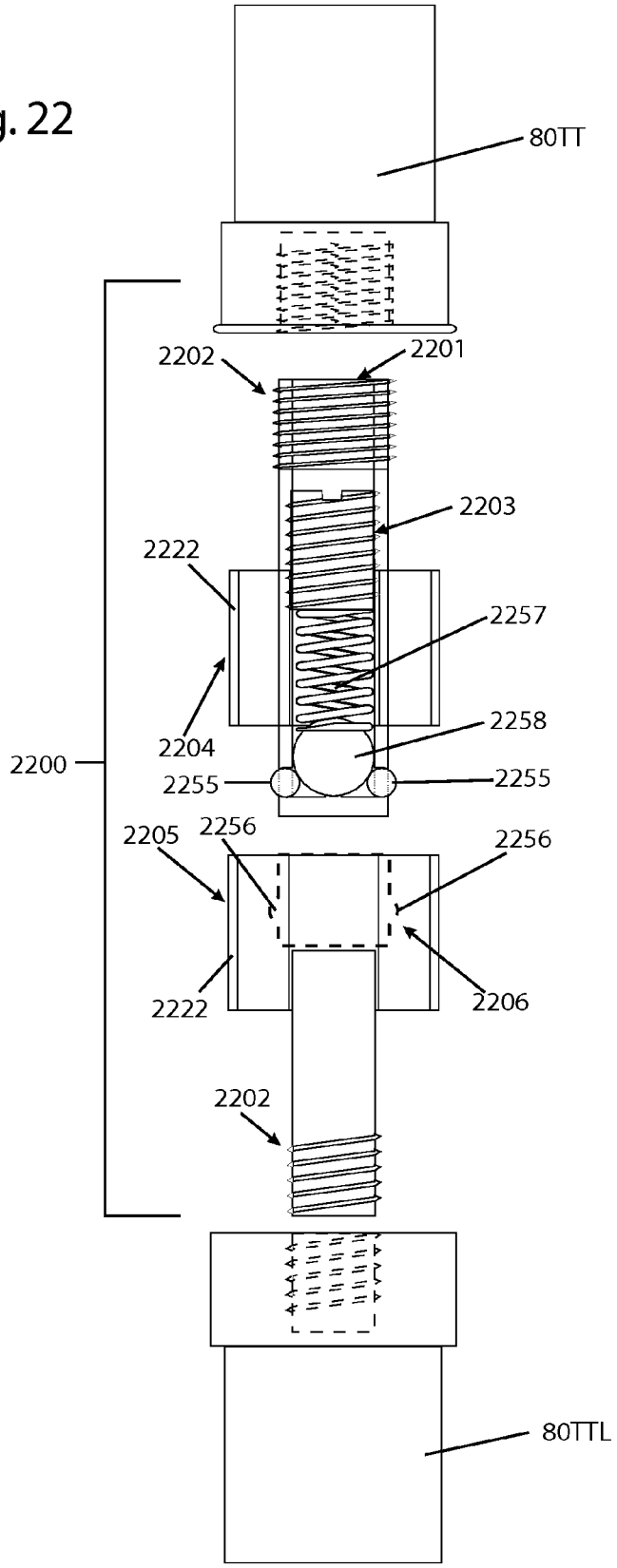
FIG. 22 is an exploded view of an optional adjustable ball lock alignment pin.

Referring last to FIG. 22 a safety breakaway assembly 2200 allows the door to be slammed upon or shut without unlocking the male locking key 2222. In this assembly 220024 the male locking key 2222 has an upper segment 2204 and a lower segment 2205. These segments can split apart rotationally when the door overpowers the ball bearings 2255 which are normally held in recesses 2256 via the spring 2257 pushing down on the ball 2258 which in turn pushes the ball bearings 2255 into the recesses 2256, adjustment screw 2203 provides an adjustment to the breakaway force needed to break the static friction of the ball bearings 2255 in the recesses 2256. The hollow tube 2201 allows access to the screw 2203 for adjustment The recess 2206 receives the lower segment of hollow tube 2201. The top button is labeled 80TT, which attaches to threads 2202, and the bottom button is labeled 80TTL, which attaches to threads 2202.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. An improvement to a door having hinges mortised into a door jamb, the improvement comprising a door jammer mounted in a space between the door and the door jamb, the door jammer comprising:

a pivoting pair of wings connected by a respective collar of each wing by a common vertical pivot pin;

a first member of the pivoting pair having a fastener for attaching the first member to an edge of the door;

said edge of the door also having a hinge butt plate affixed thereto;

a second member of the pivoting pair having a fastener for attaching the second member to the door jamb;

a collar of the second member is stationary and has a lower segment rotationally engaged in an upper segment of the first member;

a collar of the first member having a female locking bushing installed therein so as to rotate with the collar of the first member;

said common vertical pivot pin slidingly engaged in the collar of the second member;

said pivot pin having a locking gear fixedly mounted thereto;

wherein moving the common vertical pivot pin in a first direction engages the locking gear at a desired angle between the first member and the second member in the female locking bushing, thereby locking the door at the desired angle;

wherein moving the common vertical pivot pin in a second direction disengages the locking gear from the female locking bushing; and wherein the female locking bushing further comprises an adjustable mount in the collar of the first member, wherein an abrasive meshing pair is mounted inside the first member affixed stationary inside the first member, and a thumbwheel on the bottom collar can adjust a spring against the lower member of the pair to lock a second member of the pair affixed to a top of the female locking bushing at a desired position relative to the first collar thereby providing a safety release to allow the door to be forcefully moved by overcoming the resistance between the abrasive meshing pair when the common vertical pivot pin is engaged in the female locking bushing.

2. A door jamb lock comprising:

a door jamb wing having a fastener means functioning to allow attachment to a door jamb;

said door jamb wing having a grooved edge protruding into a space between a door and a door jamb when installed on the door jamb;

a door jamb wing having a fastener means functioning to allow attachment to the door;

said door wing having a grooved edge protruding into the space between the door and the door jamb when installed on the door;

a plunger having a first vertical grooved edge so as to be supported thereto; and said plunger having a second vertical groove to mate with the door wing grooved edge when the plunger is moved to simultaneously engage the door jamb wing grooved edge and the door wing grooved edge, thereby locking the door in an open position.

3. A door jammer comprising:

an upper and a lower wing each having an aligned collar to receive a pivot pin and each having a fastener means functioning to allow attachment to a door jamb;

a center wing having a collar aligned with both the upper and lower wing collars so as to swing freely when the pivot pin is mounted through all the wing collars;

said center wing having a cutout and a distal edge from the pivot pin;

a stop having at least one notch;

said stop being mounted to the door so as to allow the notch to engage the distal edge, thereby jamming the door open; and wherein closing the door and removing the distal edge from the notch, the cutout receives the stop, thereby allowing the door to fully close.

* * * * *